US010337507B2

(12) United States Patent
Lifson et al.

(10) Patent No.: US 10,337,507 B2
(45) Date of Patent: Jul. 2, 2019

(54) BYPASS UNLOADER VALVE FOR COMPRESSOR CAPACITY CONTROL

(75) Inventors: Alexander Lifson, Manlius, NY (US); Michael F. Taras, Fayetteville, NY (US)

(73) Assignee: CARRIER CORPORATION, Farmington, CT (US)

( * ) Notice: Subject to any disclaimer, the term of this patent is extended or adjusted under 35 U.S.C. 154(b) by 798 days.

(21) Appl. No.: 13/382,379

(22) PCT Filed: May 24, 2010

(86) PCT No.: PCT/US2010/035896
§ 371 (c)(1),
(2), (4) Date: Jan. 5, 2012

(87) PCT Pub. No.: WO2011/005367
PCT Pub. Date: Jan. 13, 2011

(65) Prior Publication Data

US 2012/0107159 A1 May 3, 2012

Related U.S. Application Data

(60) Provisional application No. 61/223,263, filed on Jul. 6, 2009.

(51) Int. Cl.
*F04B 39/08* (2006.01)
*F04B 49/03* (2006.01)
(Continued)

(52) U.S. Cl.
CPC ..... *F04B 49/225* (2013.01); *F04B 1/0452* (2013.01); *F04B 39/08* (2013.01);
(Continued)

(58) Field of Classification Search
CPC ..... F04B 27/067; F04B 49/035; F04B 49/03; F04B 49/06; F04B 49/225; F04B 39/08
(Continued)

(56) References Cited

U.S. PATENT DOCUMENTS 2,054,640 A 9/1936 Stenger
2,961,148 A * 11/1960 Courtney, Jr. ..... 417/282
(Continued)

FOREIGN PATENT DOCUMENTS

EP 0127559 A1 12/1984
EP 1279833 A2 1/2003
(Continued)

OTHER PUBLICATIONS

PCT International Search Report and Written Opinion of the International Searching Authority for International Application No. PCT-US2010/035896, dated Dec. 29, 2010, 9 pages.
(Continued)

*Primary Examiner* — Peter J Bertheaud
(74) *Attorney, Agent, or Firm* — Cantor Colburn LLP

(57) ABSTRACT

A reciprocating compressor includes a cylinder block, a cylinder head, and a bypass unloader valve assembly. The cylinder block has a cylinder disposed therein. The cylinder head is secured to the cylinder block overlying the cylinder and has a suction plenum and a discharge plenum in selective fluid communication with the cylinder. The bypass unloader valve assembly is in operable communication with the cylinder head and is responsive to control signals to rapid cycle to allow for fluid communication of a refrigerant between the discharge plenum and the suction plenum.

11 Claims, 3 Drawing Sheets

(51) Int. Cl.

| | |
|---|---|
| ***F04B 49/06*** | (2006.01) |
| ***F04B 49/22*** | (2006.01) |
| ***F04B 49/035*** | (2006.01) |
| ***F04B 1/04*** | (2006.01) |

(52) U.S. Cl.
CPC ..... *F04B 49/03* (2013.01); *F04B 49/035* (2013.01); *F04B 49/06* (2013.01)

(58) Field of Classification Search
USPC ..... 417/440
See application file for complete search history.

(56) References Cited

U.S. PATENT DOCUMENTS

| | | | | |
|---|---|---|---|---|
| 3,119,550 | A * | 1/1964 | West et al. | 417/286 |
| 3,303,988 | A * | 2/1967 | Weatherhead | 417/298 |
| 3,738,116 | A | 6/1973 | Gazda | |
| 4,060,997 | A | 12/1977 | Shultz et al. | |
| 4,326,839 | A | 4/1982 | Fry et al. | |
| 4,685,489 | A | 8/1987 | Yun et al. | |
| 5,782,101 | A | 7/1998 | Dennis | |
| 6,058,729 | A | 5/2000 | Lifson et al. | |
| 6,138,467 | A | 10/2000 | Lifson et al. | |
| 6,203,285 | B1 * | 3/2001 | Wagner et al. | 417/243 |
| 7,080,521 | B2 | 7/2006 | Ludwig | |
| 7,152,416 | B2 | 12/2006 | Lifson et al. | |
| 7,260,946 | B2 | 8/2007 | Ludwig et al. | |
| 7,266,961 | B2 | 9/2007 | Ludwig et al. | |
| 2007/0033957 | A1 | 2/2007 | Taras et al. | |

FOREIGN PATENT DOCUMENTS

| | | | | |
|---|---|---|---|---|
| JP | 2003166667 | A | 6/2003 | |
| JP | 2003172256 | A | 6/2003 | |
| WO | WO9966203 | A1 | 12/1999 | |
| WO | WO2008/079122 | A1 * | 7/2008 | F25B 49/00 |

OTHER PUBLICATIONS

European Search Report for application 10797488.3, dated Sep. 1, 2015, 7 pages.

* cited by examiner

BYPASS UNLOADER VALVE FOR COMPRESSOR CAPACITY CONTROL

BACKGROUND

Refrigeration and air conditioning systems are commonly configured with means for system capacity control, thereby allowing the systems to improve temperature control accuracy, reliability, and energy efficiency.

Currently the most common means of refrigerant system capacity control is accomplished by unit cycling (turning the compressor on and off in response to fluctuations in temperature or system pressure). However, unit cycling does not allow for tight temperature control, and therefore, commonly creates discomfort and/or undesired temperature variations in the conditioned/refrigerated space.

A suction modulation valve located on a suction line downstream of the compressor is another means commonly utilized for system capacity control. However, suction modulation valves are expensive and are inefficient for system capacity control.

A hot gas bypass unloader valve integral to the compressor can be used to control compressor capacity, and hence, refrigeration and air conditioning system capacity. The bypass unloader valve operates to re-circulate refrigerant vapor from the discharge plenum back to the suction plenum. Thus, there is no compression generated flow of refrigerant out of the cylinder when the bypass unloader valve is actuated. Unfortunately, bypass unloader valves only control compressor (and system) capacity in distinct increments or modes. For example, in a four cylinder compressor with two pairs of cylinders, a fifty percent capacity reduction is achieved by actuating the bypass unloader valve adjacent one of the two pairs of cylinders. However, a capacity reduction of, for example, twenty five percent could not be achieved in the four cylinder compressor with the bypass unloader valve. Thus, optimal control of compressor capacity, and hence, the refrigerated or air conditioned environment cannot be achieved with current bypass unloader valve technology.

SUMMARY

A reciprocating compressor includes a cylinder block, a cylinder head, and a bypass unloader valve assembly. The cylinder block has a cylinder disposed therein. The cylinder head is secured to the cylinder block overlying the cylinder and has a suction plenum and a discharge plenum in selective fluid communication with the cylinder. The bypass unloader valve assembly is in operable communication with the cylinder head and is responsive to control signals to rapid cycle to allow for fluid communication of a refrigerant between the discharge plenum and the suction plenum.

DETAILED DESCRIPTION

Figure 1A:
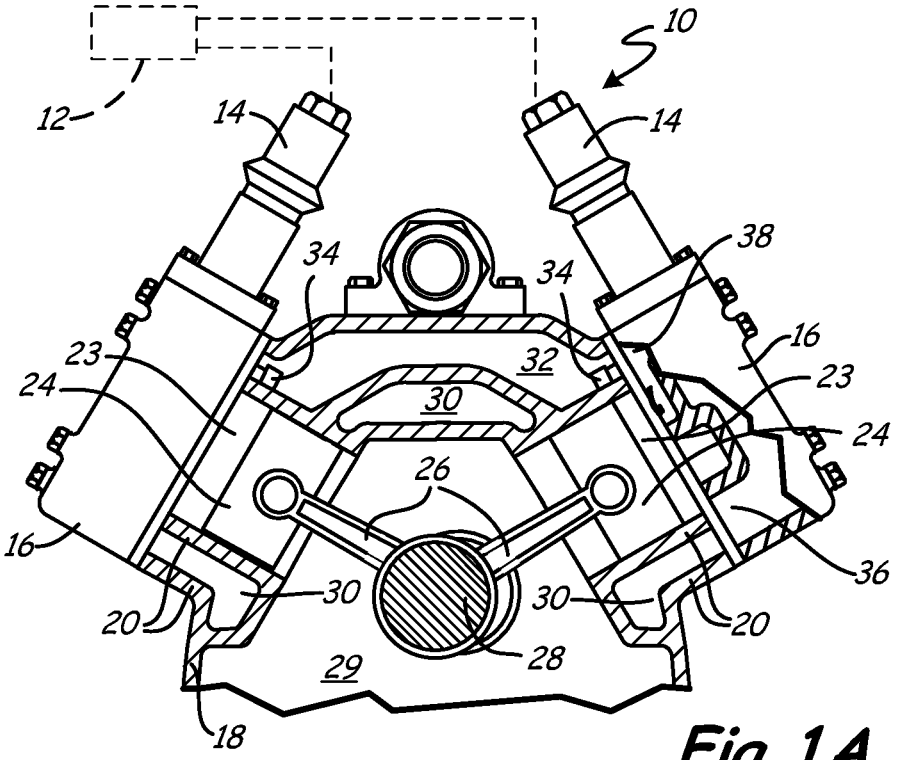
FIG. 1A is a cross-sectional view of one embodiment of a reciprocating compressor with a controller electrically connected to bypass unloader valve assemblies.
Figure 1B:
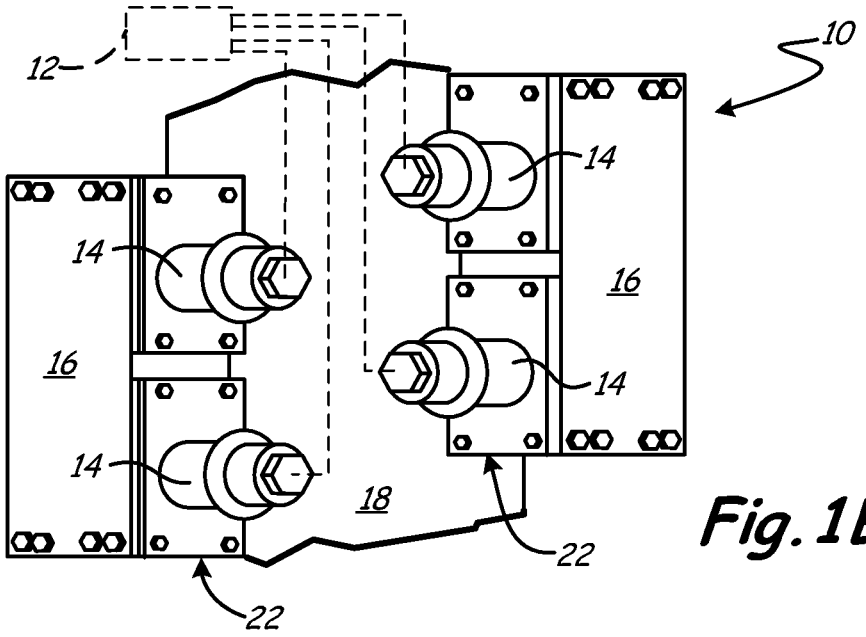
FIG. 1B is a view of the compressor of FIG. 1A looking down on the cylinder heads which have bypass unloader valve assemblies extending therefrom.

FIG. 1A shows a cross-section of a reciprocating compressor 10 with a controller 12 electrically connected to multiple bypass unloader valve assemblies 14. FIG. 1B shows the reciprocating compressor 10 with cylinder heads 16 having multiple bypass unloader valve assemblies 14 extending therefrom. In addition to the bypass unloader valve assemblies 14 and cylinder heads 16, the compressor 10 includes a housing 18, a cylinder block 20, cylinder banks 22, cylinders 23, pistons 24, connecting rods 26, a crankshaft 28, an oil sump 29, a suction manifold 30, a discharge manifold 32, and check valves 34. Each of the cylinder heads 16 includes a suction plenum 36 and a discharge plenum 38.

The reciprocating compressor 10 has bypass unloader valve assemblies 14 which interconnect with the cylinder heads 16. The housing 18 of the compressor 10 has an upper portion of which forms the cylinder block 20. The cylinder block 20 is divided into one or more cylinder banks 22, as the compressor 10 is illustrated as a multi-cylinder compressor. The cylinder block 20 defines cylinders 23 which extend therethrough to adjacent the cylinder head 16. Each cylinder head 16 is secured to the cylinder block 20 and overlays the cylinders 23 in each cylinder bank 22. Each cylinder bank 22 has at least one cylinder 23 and may include multiple cylinders 23 as illustrated in FIG. 1B.

The pistons 24 are disposed in the cylinders 23 and are reciprocally movable therein. The pistons 24 interconnect with the connecting rods 26 which extend internally within the compressor 10 to interconnect with an eccentric portion of the crankshaft 28. The crankshaft 28 is rotatably disposed internally in the compressor 10 and extends through the oil sump 29. The suction manifold 30 and discharge manifold 32 are defined by the cylinder block 20. The check valve 34 extends from the cylinder block 20 into the discharge manifold 32.

Each of the cylinder heads 16 define a suction plenum 36 and discharge plenum 38 which selectively communicate with one another by virtue of actuation of the bypass unloader valve assembly 14. The suction manifold 30 communicates with the oil sump 29 or directly with a suction line (not shown). The suction manifold 30 extends to the cylinder heads 16 to fluidly communicate with the suction plenum 36. The discharge manifold 32 selectively fluidly communicates with the discharge plenum 38 through ports adjacent the check valves 34. The discharge manifold 32 also selectively fluidly communicates with the suction plenum 36 by virtue of actuation of the bypass unloader valve assembly 14.

In one embodiment, when the compressor 10 is in a loaded mode of operation, i.e. the bypass unloader valve assemblies 14 are deactivated and are not cycling, a low pressure refrigerant enters the compressor 10 from the suction line (not shown) through an inlet port (not shown). The reciprocating movement of the pistons 24 within the cylinders 23 draws the refrigerant from the suction line (not shown) through the oil sump 29. The refrigerant is drawn into the suction manifold 30 formed by the cylinder block 28 and into the suction plenum 36 in the cylinder head 16. From the suction plenum 36 the refrigerant passes into the cylinders 23 where it is compressed by the pistons 24. Reed valves (not shown) are positioned above the cylinders 23 to control the flow of refrigerant thereto. After leaving the cylinders 23, the high pressure vapor refrigerant is discharged through the reed valves (not shown) into the discharge plenum 38. In the loaded mode, the discharge pressure of the refrigerant forces open the check valves 34 to permit the passage of the refrigerant to the discharge manifold 32. From the discharge manifold 32 the high pressure vapor refrigerant passes through an outlet port (not shown) to other components of the heating or cooling system.

When the compressor 10 is in an unloaded mode of operation, i.e. the bypass unloader valve assemblies 14 are fully activated or deactivated and are not cycling, the compressor 10 operates as described above up until the point at which the refrigerant is discharged from the cylinders 23 into the discharge plenum 38. Because the bypass unloader valve assemblies 14 are activated, a portion of the bypass unloader valve assemblies 14 is drawn back allowing the discharge plenum 38 to communicate directly with the suction plenum 36. Thus, the refrigerant passes to the suction plenum 36 from the discharge plenum 38 because of the pressure differential therebetween, and a pressure sufficient to open the check valves 34 does not develop. Additionally, when the bypass unloader valve assemblies 14 are activated a second portion of the valve assemblies 14 is withdrawn from a blocking arrangement allowing the discharge manifold 32 to fluidly communicate with the suction plenum 36. Thus, the refrigerant passes to the suction plenum 36 from the discharge manifold 32 because of the pressure differential therebetween, and substantially no high pressure vapor refrigerant passes through an outlet port (not shown) to other components of the heating or cooling system.

As will be discussed in greater detail subsequently, one or all of the bypass unloader valve assemblies 14 can be operated in rapid cycle (for example by pulse width modulation) to provide for a continuously variable capacity (partial load mode) between the capacity achieved by the compressor 10 when the bypass unloader valve assemblies 14 are in the unloaded position, and the capacity achieved by the compressor 10 when the bypass unloader valve assemblies 14 are in the loaded position. The bypass unloader valve assemblies 14 achieve the partial load mode by cycling each or all of the bypass unloader valve assemblies 14 between the loaded position and the unloaded position with a period that is between 1 cycle/second and 1 cycle/180 seconds. This cycle period is short enough to account for the inertia of the reaction of the refrigeration or air conditioning system. Thus, only small temperature fluctuations occur in the evaporator (not shown), these temperature fluctuations do not impair precise regulation of unit being refrigerated or conditioned.

FIG. 1B is a view looking down at the compressor 10 from above the cylinder heads 16 and bypass unloader valve assemblies 14. In FIG. 1B, the cylinders 23 are shown in phantom. As illustrated, each cylinder bank 22 has multiple cylinders 23 with a corresponding bypass unloader valve assembly 14 located adjacent each cylinder 23. In another embodiment, each cylinder bank 22 has high and low stage cylinders 23 with a corresponding bypass unloader valve assembly 14 located above each stage of cylinders 23. The arrangement of each bypass unloader valve assembly 14 (corresponding to each cylinder 23) allows the controller 12 to activate or deactivate at least one bypass unloader valve assembly 14 to assume a loaded or unloaded position, while activating at least one bypass unloader valve assembly 14 to rapidly cycle. Rapid cycle of all the bypass unloader valve assemblies 14 or loading/unloading at least one bypass unloader valve assembly 14 while rapid cycle of at least one bypass unloader valve assembly 14 allows for greater compressor 10 capacity control, allowing the bypass unloader valve assemblies 14 to dial in on any desired capacity between about 5% and 100%. For example, if the compressor 10 has three bypass unloader valve assemblies 14, two of the bypass unloader valve assemblies 14 can be activated or deactivated to close (be in the loaded position) while the other bypass unloader valve assembly 14 is operated in rapid cycle. In this manner, a compressor 10 capacity of between about 67% to 100% can be achieved. Alternatively, one bypass unloader valve assembly 14 can be open (be in the unloaded position), the second bypass unloader valve assembly 14 can be closed (be in the unloaded position), and the third bypass unloader valve assembly can be operated rapid cycle. In this manner, a compressor 10 capacity of between about 33% to 67% can be achieved. In yet another alternative, two bypass unloader valve assemblies 14 can be open (be in an unloaded position) and the third bypass unloader valve assembly 14 can operate in rapid cycle to achieve a compressor 10 capacity from about or below 5% to 33%. In an embodiment with only two valves bypass unloader valve assemblies 14, compressor 10 capacities about or below 5% to 50% and about 50% and 100% can be achieved by operating one bypass unloader valve assembly 14 and either opening or closing the second bypass unloader valve assembly 14. The greater compressor 10 capacity control achieved with the bypass unloader valve assemblies 14 allows the refrigeration or air conditioning system to achieve improved temperature control accuracy, reliability, and energy efficiency.

While the compressor 10 is shown as a four cylinder single stage compressor having two cylinder banks 22 of paired cylinders 23, it is understood that additional cylinder banks or cylinders may be provided. Some or all of the cylinders in the cylinder banks 22 may be provided with bypass unloader valve assemblies 14. Alternatively, the compressor 10 can be a multi-stage compressor having dedicated staged cylinder banks or staged cylinders with the banks or cylinders provided with bypass unloader valve assemblies 14.

Figure 2A:
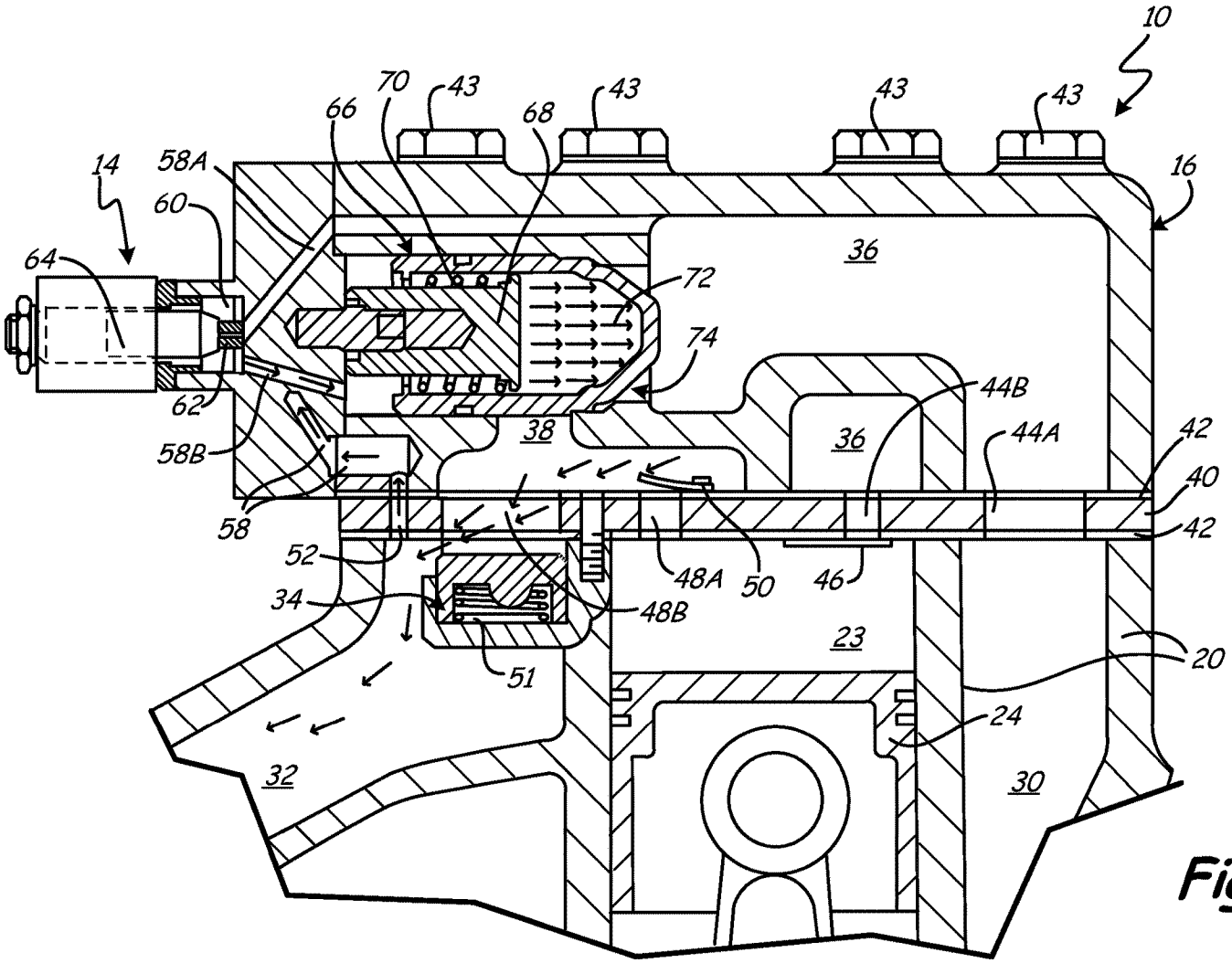
FIG. 2A is a partial sectional view of the bypass unloader valve assembly, the cylinder head, and a cylinder block of the compressor of FIG. 1A with the bypass unloader valve assembly in a loaded position.
Figure 2B:
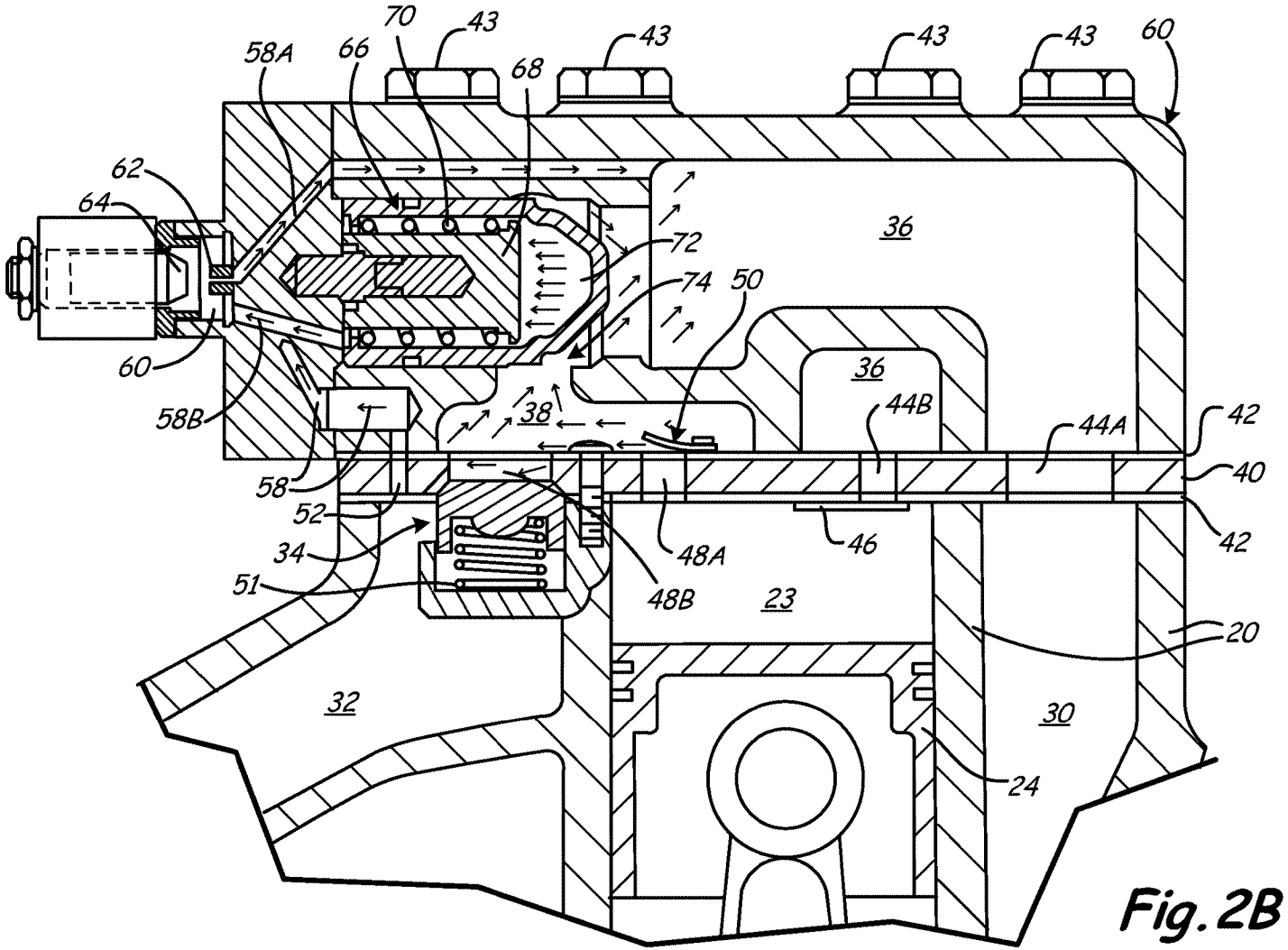
FIG. 2B is a partial sectional view of the cylinder block, cylinder head, and bypass unloader valve assembly of the compressor of FIG. 1A with the bypass unloader valve assembly in an unloaded position.

FIG. 2A is a partial sectional view of the compressor 10 with the bypass unloader valve assembly 14 in a loaded position. FIG. 2B is a partial sectional view of the compressor 10 with the bypass unloader valve assembly 14 in an unloaded position. In addition to the bypass unloader valve assembly 14, cylinder head 16, cylinder block 20, cylinders 23, pistons 24, suction manifold 30, discharge manifold 32, and check valve 34, the compressor 10 includes a valve plate 40, gaskets 42, fasteners 43, suction ports 44A and 44B, a suction valve 46, discharge ports 48A and 48B, a discharge valve 50, and a bypass port 52. In addition to the suction plenum 36 and discharge plenum 38, the cylinder head 16 includes a channel 58. The bypass unloader valve assembly 14 includes the channel 58, channels 58A and 58B, a high pressure chamber 60, a valve seat 62, a solenoid 64, and a valve piston 66. The valve piston 66 includes a guide 68, bias spring 70, and internal piston chamber 72.

In FIGS. 2A and 2B, the cylinder head 16 overlays the cylinder block 20 and cylinder 23. The valve plate 40 is disposed between the cylinder block 20 and cylinder head 16. The gaskets 42 are positioned on the top and bottom surfaces of the valve plate 40 and contact the cylinder head 16 and cylinder block 20 respectively. The fasteners 43 secure the cylinder head 16 to the cylinder block 20 and the bypass unloader valve assembly 14 to the cylinder head 16. The valve plate 40 defines suction ports 44A and 44B.

Suction port 44A extends through the valve plate 40 between the suction manifold 30 and the suction plenum 36. Suction port 44B extends through the valve plate 40 between the suction plenum 36 and the cylinder 23. The suction valve 46 contacts the valve plate 40 and selectively covers the suction port 44B. The suction valve 46 is selectively movable from over the suction port 44B to allow refrigerant to enter the cylinder 23. The discharge port 48A extends through the valve plate 40 between the cylinder 23 and the discharge plenum 38. Discharge valve 50 connects to the valve plate 40 and interacts with the valve plate 40 to selectively cover and uncover the discharge port 48A. Discharge port 48B extends through the valve plate 40 between the discharge plenum 38 and the discharge manifold 32. In the loaded position illustrated in FIG. 2A, the bias of spring 51 on the check valve 34 is overcome and the check valve 34 is removed from a blocking arrangement with respect to the discharge port 48B. In the unloaded position illustrated in FIG. 2B, the bias of spring 51 keeps the check valve 34 in a blocking arrangement with respect to the discharge port 48B.

Bypass port 52 extends through the valve plate 40 and communicates with the channel 58 which extends through the casing of the cylinder head 16 and stator casing portion of the bypass unloader valve assembly 14 to connect to the high pressure chamber 60 through a bleed orifice (not shown do to the cross sectional view selected in FIGS. 2A and 2B). Channel 58A extends from high pressure chamber 60 through the valve seat 62 to the suction plenum 36 (around the valve piston 66), while the second channel 58B extends to adjacent the valve piston 66 from the high pressure chamber 60. More specifically, the channel 58B extends to communicate with the internal piston chamber 72 adjacent the stationary guide 68 and bias spring 70. The valve piston 66 is movable relative to the guide 68 and is acted upon by the bias spring 70. The hollow internal piston chamber 72 is defined by the casing of the valve piston 66.

In FIGS. 2A and 2B, the gaskets 42 create a hermetic seal between the valve plate 40 and cylinder head 16, and the valve plate 40 and cylinder block 20. Suction port 44A provides a pathway for refrigerant to fluidly communicate from the suction manifold 30 to the suction plenum 36. Suction port 44B provides a pathway for refrigerant to be drawn by reciprocation of the piston 24 from the suction plenum 36 to the cylinder 23. The suction valve 46 selectively covers the suction port 44B to substantially block fluid communication of the refrigerant from the suction plenum 36 to the cylinder 23 and is selectively movable from over the suction port 44B to allow refrigerant to enter the cylinder 23 during a suction portion of the piston 24 stroke. The discharge port 48A allows high pressure compressed refrigerant to fluidly communicate from the cylinder 23 to the discharge plenum 38 with the discharge stroke of the piston 24. Discharge valve(s) 50 selectively covers the discharge port 48A to substantially block fluid communication of the refrigerant from the cylinder 23 to the discharge plenum 38 until the refrigerant is a sufficient pressure. Discharge port 48B provides a pathway for compressed refrigerant to fluidly communicate from the discharge plenum 38 to the discharge manifold 32. In the loaded position illustrated in FIG. 2A, the bias of spring 51 on the check valve 34 is overcome and the check valve 34 is removed from a blocking arrangement in discharge port 48B, thereby allowing the high pressure compressed refrigerant to fluidly communicate from the discharge plenum 38 to the discharge manifold 32. In FIG. 2B, the valve piston 66 does not block opening 74 (as will be discussed in greater detail subsequently) such that refrigerant within the discharge plenum 38 does not build up sufficient pressure to overcome the bias of spring 51 on the check valve 34. Because refrigerant passes through the opening 74 to the suction plenum 36 (due to a pressure differential therebetween) rather than building pressure in the discharge plenum 38, the check valve 34 remains in a blocking arrangement with the port 48B.

The channel 58 extends from the discharge manifold 32 (through bypass port 52) to the high pressure chamber 60 to allow refrigerant to communicate therewith. In the loaded position illustrated in FIG. 2A, the portion of the channel 58A extending from high pressure chamber 60 (through the valve seat 62) to the suction plenum 36 is substantially blocked by the solenoid 64 which contacts the valve seat 62 within the high pressure chamber 60. Thus, the refrigerant is directed from the high pressure chamber 60 through a second section of the channel 58B into the valve piston 66. More specifically, the refrigerant flows past the stationary guide 68 and bias spring 70 into the internal piston chamber 72. The refrigerant causes the internal pressure to build within the internal piston chamber 72 to a level sufficient to overcome the inward (i.e. toward the remainder of the bypass unloader valve assembly 14 including the channel 58B and high pressure chamber 60) bias the bias spring 70 exerts on the valve piston 66. After overcoming this bias, the valve piston 66 moves within the cylinder head 16 to close the opening 74 between the discharge plenum 38 and the suction plenum 36 such that substantially no refrigerant can communicate therebetween.

In the unloaded position illustrated in FIG. 2B, the solenoid 64 is actuated by controller 12 (FIG. 1A) away from blocking contact with the valve seat 62 (through which channel 58A extends) within the high pressure chamber 60. Thus, high pressure refrigerant is drawn by pressure differential through the channel 58A from the high pressure chamber 60 to the suction plenum 36. By removing the solenoid 64 from blocking contact with the valve seat 62 to allow for communication between the discharge manifold 32 and the suction plenum 36, the pressure build up is relieved from the internal piston chamber 72 such that the bias spring 70 returns the valve piston 66 inward (i.e. toward the remainder of the bypass unloader valve assembly 14 including the channel 58B and high pressure chamber 60). The movement of the valve piston 66 unblocks opening 74 to allow for the communication of refrigerant between the discharge plenum 38 and the suction plenum 36.

As discussed previously, the bypass unloader valve assemblies 14 can be operated in a rapid cycle to provide a continuously variable capacity (partial load mode) between the capacity achieved by the compressor 10 when the bypass unloader valve assembly 14 is in the unloaded mode, and the capacity achieved by the compressor 10 when the bypass unloader valve assembly 14 is in the loaded position. More specifically, the solenoid 64 can be activated by the controller 12 to operate in a rapid cycle and provide for a continuously variable capacity by blocking and unblocking the channel 58A in rapid fashion to allow/disallow communication between the discharge manifold 32 and the suction plenum 36 (and to cause valve piston 66 to move and block/unblock opening 74 between the discharge plenum 38 and the suction plenum 36). The solenoid 64 can cycle between the loaded position of FIG. 2A and the unloaded position of FIG. 2B either rapidly or slowly as dictated by the inertia of the system. Inertia can be calculated, for example, by a temperature sensor at the evaporator (not shown), this temperature reading is transferred to the controller 12 (FIG. 1A) which then generates a control signal for the bypass unloader valve assemblies 14. In one embodiment, the cycle period of the bypass unloader valve assembly 14 and solenoid 64 is between 1 cycle/second and 1 cycle/180 seconds. In another embodiment, the cycle period is between 1 cycle/3 seconds and 1 cycle/30 seconds. In yet another embodiment, the cycle period of the bypass unloader valve assembly 14 is approximately 1 cycle/15 seconds. In another embodiment where the compressor has at least two bypass unloader valve assemblies, one bypass unloader valve assembly can be configured to remain in the unloaded position or the loaded position for an extended period of time exceeding 180 seconds.

Pulse width modulation of the solenoid 64 of the bypass unloader valve assembly 14 allows for greater compressor 10 capacity control, thereby allowing the bypass unloader valve assembly 14 to rapid cycle and dial in on a desired compressor 10 capacity. Greater compressor 10 capacity control allows the refrigeration or air conditioning system to achieve improved temperature control accuracy, reliability, and energy efficiency.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A reciprocating compressor having a cylinder, the reciprocating compressor comprising:

a cylinder block defining the cylinder;

a cylinder head secured to the cylinder block overlying the cylinder, the cylinder head comprising a suction plenum and a discharge plenum in selective fluid communication with the cylinder; and a bypass unloader valve assembly in operable communication with the cylinder head and responsive to control signals to rapid cycle to allow for fluid communication of a refrigerant between the discharge plenum and the suction plenum;

wherein the bypass unloader valve assembly is operable to unload the cylinder associated with the corresponding bypass unloader valve assembly;

wherein a period of the rapid cycle of the bypass unloader valve assembly is between 1 cycle/second and 1 cycle/180 seconds;

wherein the bypass unloader valve assembly has a solenoid, the control signals operating the solenoid in a pulse width modulation mode to provide for the rapid cycle;

wherein the rapid cycle is between an unloaded position in which the discharge plenum is in fluid communication with the suction plenum and a loaded position in which the bypass unloader valve assembly is disposed to substantially restrict fluid communication between the discharge plenum and the suction plenum;

wherein the rapid cycle provides the reciprocating compressor with a continuously variable capacity between the capacity achieved when the bypass unloader valve assembly is in the unloaded position and the capacity achieved by the reciprocating compressor when the bypass unloader valve assembly is in the loaded position.

2. The reciprocating compressor of claim 1, wherein the reciprocating compressor includes a suction manifold and a discharge manifold integral to the reciprocating compressor and in the unloaded position the discharge plenum and the discharge manifold are in fluid communication with the suction plenum and in the loaded position the bypass unloader valve assembly is disposed to halt fluid communication between the discharge plenum and both the discharge manifold and suction plenum.

3. The reciprocating compressor of claim 1, wherein the unloaded position is a fully unloaded position in which the bypass unloader valve assembly does not obstruct fluid communication between the discharge plenum and the suction plenum.

4. The reciprocating compressor of claim 1, wherein the loaded position is a fully loaded position in which the bypass unloader valve assembly is disposed to halt fluid communication between the discharge plenum and the suction plenum.

5. The reciprocating compressor of claim 1, further comprising a controller for electronically activating the bypass unloader valve assembly to rapid cycle.

6. The reciprocating compressor of claim 1, wherein a period of the rapid cycle of the bypass unloader valve assembly is between 1 cycle/3 seconds and 1 cycle/30 seconds.

7. The reciprocating compressor of claim 1, wherein a period of the rapid cycle of the bypass unloader valve assembly is approximately 1 cycle/15 seconds.

8. The reciprocating compressor of claim 1, wherein the cylinder block defines a bank having two or more cylinders.

9. The reciprocating compressor of claim 1, wherein the bypass unloader valve assembly is capable of being positioned in the unloaded position or the loaded position for an extended period of time exceeding 180 seconds.

10. The reciprocating compressor of claim 1, wherein the cylinder defined by the cylinder block comprises a first cylinder and a second cylinder;

the suction plenum and the discharge plenum comprises a first suction plenum and a first discharge plenum in selective fluid communication with the first cylinder and a second suction plenum and a second discharge plenum in selective fluid communication with the second cylinder;

the bypass unloader valve assembly comprises a first bypass unloader valve assembly in operable communication with the first cylinder and responsive to first control signals to rapid cycle to allow for fluid communication of the refrigerant between the first discharge plenum and the first suction plenum and a second bypass unloader valve assembly in operable communication with the second cylinder and responsive to second control signals to rapid cycle to allow for fluid communication of the refrigerant between the second discharge plenum and the second suction plenum.

11. The reciprocating compressor of claim 1, wherein the bypass unloader valve assembly is operable to unload only the cylinder associated with the corresponding bypass unloader valve assembly.

* * * * *